US007147997B2

(12) United States Patent
Nakajima et al.

(10) Patent No.: US 7,147,997 B2
(45) Date of Patent: Dec. 12, 2006

(54) SILVER SALT PHOTOTHERMOGRAPHIC DRY IMAGING MATERIAL

(75) Inventors: Akihisa Nakajima, Sagamihara (JP); Eiichi Ueda, Akishima (JP); Shinji Kudo, Hino (JP); Kenji Ohnuma, Hino (JP); Chiaki Nagaike, Asaka (JP); Miyuki Teranishi, Hino (JP)

(73) Assignee: Konica Corporation, Tokyo (JP)

( * ) Notice: Subject to any disclaimer, the term of this patent is extended or adjusted under 35 U.S.C. 154(b) by 11 days.

(21) Appl. No.: 10/658,253

(22) Filed: Sep. 9, 2003

(65) Prior Publication Data

US 2004/0063049 A1 Apr. 1, 2004

(30) Foreign Application Priority Data

Sep. 24, 2002 (JP) ..... 2002-277233

(51) Int. Cl.
*G03C 1/76* (2006.01)
*G03C 1/38* (2006.01)

(52) U.S. Cl. ..... 430/523; 527/530; 527/531; 527/533; 527/627; 527/631

(58) Field of Classification Search ..... 430/619, 430/631, 627, 531, 527, 530, 533, 523
See application file for complete search history.

(56) References Cited

U.S. PATENT DOCUMENTS 3,681,269 A * 8/1972 Heitz et al. ..... 521/149
5,532,121 A * 7/1996 Yonkoski et al. ..... 430/617
6,190,854 B1 * 2/2001 Sampei ..... 430/617
6,475,697 B1 * 11/2002 Arimoto et al. ..... 430/263

* cited by examiner

*Primary Examiner*—Thorl Chea
(74) *Attorney, Agent, or Firm*—Lucas & Mercanti, LLP

(57) ABSTRACT

A silver salt photothermographic dry imaging material comprising a support having thereon a photosensitive layer and a polymer layer, wherein the polymer layer comprises a copolymer of: (i) a fluorine containing acrylate or a fluorine containing methacrylate; and (ii) a monomer having a hydrophobic group in the molecule.

7 Claims, No Drawings

SILVER SALT PHOTOTHERMOGRAPHIC DRY IMAGING MATERIAL

TECHNICAL FIELD

The present invention is related to an image recording material, specifically to an antistatic technology applied to a silver salt photothermographic material.

BACKGROUND

In the field of producing medical images, a silver halide photographic sensitized material has been employed, meanwhile, a silver salt photothermographic dry imaging material which is a recording medium regarding no need to conduct processes of a developing step, a fixing step and a washing step, is proposed.

In patent document 1, patent document 2 and non-patent document 1, identified in a following paragraph, thermo-developable photographic sensitized materials to form photographic images using a thermo-development method are disclosed. The thermo-developable recording media based on this method are expected to be applied in various fields, due to no discharge of a waste material such as a separate sheet, and the ease of forming images using only a heating treatment.

Further, this recording media produces images by processing employing a thermo-development apparatus with a laser light-source. However, the recording media needs to be stably transported under various conditions, and there exists the possibility of generation of static electricity which may cause defects.

The generation of electrostatic charges varies based on the exterior environment, seasonal variations, weather, ambient environment where the apparatus is placed, and ambient conditions where the image recording materials is placed, thus, an electrostatic charge control technology, so-called anti-static technology, is required which is effective under various conditions where the image recording materials are employed.

As electrostatic charge control technology, a technology is known that decreases the amount of separation electrostatic charge generated by contact and separation with certain materials, so-called triboelectric series adjusting technology. Another technology is known using a surface active agent containing a long chain perfluoroalkyl group, a so-called fluorinated surface active agent. However, a fluorinated surface active agent tends to transfer and buildup on the conveyance system in the apparatus, due to its low molecular weight. Therefore, there have been problems with accumulation and transfer of a fluorinated surface active agent on the sheet feeding rollers, and staining of image recording media and transfer failure due to slippage.

In patent document 3, as an antistatic technology of a photographic element is a proposal of a photographic element which contains a polyurethane having a tensile elongation to break of at least 50% and a Young's modulus at 2% elongation of at least 344,737 kPa, a copolymer composed of repeating unit of A and B wherein A comprises a fluorine containing acrylate or a fluorine containing methacrylate monomer and B comprises an ethylenically unsaturated monomer containing groups which can be hydrated and an electrically conductive agent.

The copolymer used in that invention has drawbacks such as adhesion onto the high temperature roller during heat development due to the lowered Tg, in turn due to the long length of a perfluoroalkyl chain of the used polymer containing fluorine, the tendency of adhesion onto the sheet feeding rollers due to high polar characteristics, becoming sticky at high humidity, and being difficult to dissolve when the coating solvent is an organic solvent.

The technologies related to the present invention are described in the following documents.

Patent document 1=U.S. Pat. No. 3,152,904

Patent document 2=U.S. Pat. No. 3,457,075

Patent document 3=JP-A 2000-284420 (hereinafter, the term JP-A refers to Japanese Patent Application Publication)

Non-patent document 1="Thermally Processed Silver System" (Imaging Processes and Materials), Neblette's $8^{th}$ edition, edited by J. M. Sturge, V. Walworth, and A. Shepp, $2^{nd}$ paragraph, (1969).

SUMMARY

An object of the present invention is to overcome the drawbacks of the prior technology. That is, the present invention is a proposed draft regarding a novel antistatic technology of a silver salt photothermographic dry imaging material, which is an antistatic technology exhibiting non-transfer nor tackiness even under conditions of high temperature and high humidity, and provides a silver salt photothermographic dry imaging material using an antistatic agent which is easily dissolved in an organic solvent.

The present invention to overcome the foregoing drawbacks comprises the following composition.

1. A silver salt photothermographic dry imaging material comprising a support, at least one layer thereon, wherein the layer contains a copolymer having a fluorine containing acrylate and/or fluorine containing methacrylate, and a monomer having a hydrophobic group.

2. The silver salt photothermographic dry imaging material comprising a support, at least one layer thereon, wherein the layer contains fluorine atoms derived from the polymer at least 4 mmol/$m^2$, which polymer is a copolymer having a fluorine containing acrylate and/or fluorine containing methacrylate, and a monomer having a hydrophobic group.

3. The silver salt photothermographic dry imaging material comprising a support, on at least one layer thereon, wherein at least 0.1–15 weight % of the polymer containing layer is a copolymer having a fluorine containing acrylate and/or fluorine containing methacrylate, and a monomer having a hydrophobic group.

4. The silver salt photothermographic dry imaging material comprising a support, at least one layer thereon described in any of 1. through 3. above, wherein the polymer containing layer is the outermost layer on the support.

The polymer containing layer of the present invention is provided as the outermost surface on the layer, and is intended to be used as a protective layer or a backing layer.

5. The silver salt photothermographic dry imaging material comprising a support, at least one layer thereon described in any of 1. through 4. above, wherein a fluorine containing acrylate and/or fluorine containing methacrylate have a constituent element represented by Formula (1).

Formula (1)

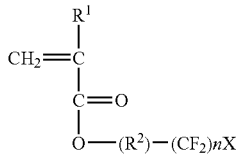

In the formula, $R^1$ represents a hydrogen atom, a fluorine atom or a methyl group; $R^2$ represents a methylene group, an ethylene group or a 2-hydrokypropylene group; X represents a hydrogen atom or a fluorine atom; and "n" represents an integer of 1–4.

6. The silver salt photothermographic dry imaging material comprising a support, at least one layer thereon described in any of 1. through 5. above, wherein a monomer unit having a hydrophobic group is represented by Formula (2).

Formula (2)

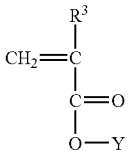

In the formula, $R^3$ represents a hydrogen atom or a methyl group; and Y represents an alkyl group, an alicyclic group or an aromatic ring group.

7. The silver salt photothermographic dry imaging material comprising a support, at least one layer thereon described in any of 1. through 6. above, wherein a polymer comprises a monomer having an epoxy group as a copolymerization component.

8. The silver salt photothermographic dry imaging material comprising a support, at least one layer thereon described in any of 5. through 7. above, wherein the polymer contains at least 20 mol % of a monomer unit represented by foregoing Formula (1).

9. The silver salt photothermographic dry imaging material comprising a support, at least one layer thereon described in any of 1. through 8. above, wherein the polymer is polymerized with a pearl polymerization method.

The polymer containing layer of this invention is preferably provided as a back coated layer.

10. The silver salt photothermographic dry imaging material described in any of 1. through 9. above, the dry imaging material comprising further an electrically-conductive layer containing a polyester co-polymer and a tin oxide compound.

DESCRIPTION OF THE PREFERRED EMBODIMENTS

The constituent features of this invention will be described below.

The polymer of this invention is obtained by polymerization of polymer units of at least fluorine containing acrylate and/or a fluorine containing methacrylate, and can be represented by the following formula.

$$CH_2{=}C(R)COOL(Rf)X$$

Wherein R represents a methyl group, a hydrogen atom or a fluorine atom; L represents a simple bond, a straight chain or a branched alkyl group, or a hydrocarbyl group, and may be intervened by a substituted or an unsubstituted hetero atom such as O, S, N and P; Rf represents straight chain, branched chained or cyclic chained carbon atoms which is completely fluorinated; and X represents a hydrogen atom or a fluorine atom.

Of these, preferred is a monomer represented by foregoing Formula (1).

The hydrophobic group of the monomer having a hydrophobic group of this invention means that it does not have an ionic group capable of hydration, or a non-ionic group capable of hydration, in particular, it does not have a monofunctional or multifunctional carboxyl group, a sulfonic acid group, a substituted or an unsubstituted amino group, a hydroxyl group, an oxyalkylene group, and a polyoxyalkylene group.

The triboelectric series adjusting agents usable in this invention include polymers containing constituent units represented by foregoing Formula (1). The most important point in the structure of the constituent elements represented by Formula (1) is that "n" in the formula represents an integer of 1–4.

From the view point of water repellency, generally the number of carbon atoms {"n" in Formula (1)} in the perfluoro group of a perfluoro acrylate or a perfluoro methacrylate is preferably at least 8, in which water repellency is saturated. However, the inventors of this invention have diligently studied to find a polymer satisfying all of desired capability which can apply in cases when "n" was in the range of 1–4.

The above desired capability firstly means having a triboelectric series adjusting function, further having an anti-blocking property under heat and pressure, also having a good compatibility with a polymer binder comprising an existing layer, and having good solvent solubility.

The constituent element represented by Formula (1) is obtained by polymerization of respective monomers such as a fluoroalkyl acrylate, a fluoroalkyl methacrylate, and a fluoroalkyl α-fluoro acrylate.

Specifically, a fluoroalkyl acrylate and a fluoroalkyl methacrylate are preferable, and available in the market from DAIKIN Chemicals Sales Co., Ltd. under the following product names.

For example,

M-1110 (2,2,2-trifluoroethyl methacrylate),
M-1210 (2,2,3,3,3-pentafluoropropyl methacrylate),
M-1420 (2-(perfluorobutyl)ethyl methacrylate),
M-1433 (3-(perfluorobutyl)-2-hydroxypropyl methacrylate),
M-5210 (1H,1H,3H-tetrafluoropropyl methacrylate),
M-5410 (1H,1H,5H-octafluoropentyl methacrylate),
M-7210 (1H-1-(trifluoromethyl)trifluoroethyl methacrylate),
M-7310 (1H,1H,3H-hexafluorobutyl methacrylate),
R-1110 (2,2,2-trifluoroethyl acrylate),
R-1210 (2,2,3,3,3-pentafluoropropyl acrylate),
R-1420 (2-(perfluorobutyl)ethyl methacrylate),
R-1433 (3-(perfluorobutyl)-2-hydroxypropyl acrylate),
R-5210 (1H,1H,3H-tetrafluoropropyl acrylate),
R-5410 (1H,1H,5H-octafluoropentyl acrylate),
R-7210 (1H-1-(trifluoromethyl)trifluoroethyl acrylate),
R-7310 (1H,1H,3H-hexafluorobutyl acrylate).

Next, the constituent element capable of copolymerization with the compounds of Formula (1) will be described. The constituent element is represented by Formula (2), and may be obtained by copolymerization of a corresponding acrylate or methacrylate. In foregoing Formula (2), most important in this invention is that the compound represented by Formula (2) does not contain the foregoing group capable of hydration.

Examples of the above constituent elements include alkyl acrylates (such as methyl acrylate, ethyl acrylate, butyl acrylate, propyl acrylate, hexyl acrylate, 2-ethylhexyl acrylate, iso-nonyl acrylate, dodecyl acrylate, and stearyl acrylate); benzyl acrylate; cyclohexyl acrylate; alkyl methacrylates (such as methyl methacrylate, ethyl methacrylate, butyl methacrylate, propyl methacrylate, hexyl methacrylate, 2-ethylhexyl methacrylate, iso-nonyl methacrylate, dodecyl acrylate, octadecyl methacrylate, and stearyl methacrylate); benzyl methacrylate; and cyclohexyl methacrylate; but are not limited to these.

Consequently, the constituent elements having an epoxy unit capable of copolymerization with the foregoing constituent elements may be produced by copolymerization of glycidyl methacrylate, glycidyl acrylate or vinylcyclohexene monoxide.

The polymer of this invention may be polymerized from a monomer with any of several commonly known methods by polymerizing vinyl type unsaturated groups. For example, the suitable polymerization method of the monomer may be selected from a radical polymerization method using a radical initiator, an anionic polymerization using an anionic initiator, coordination anionic polymerization using a transition metal catalyst such as Ziegler-Natta catalyst, and a cationic polymerization using a cationic initiator.

Of these, employment of a radical polymerization is preferred from the industrial point of view. As a radical polymerization, used may be a bulk polymerization method by polymerizing by mixing a monomer with a radical initiator, solution polymerization by polymerizing in a solvent which dissolves both of monomers and polymers produced by the monomer, deposition polymerization by polymerizing in a solvent which dissolve monomers but not the obtained polymer, suspension polymerization by polymerizing and emulsifying in water a mixed solution for dissolving a radical initiator in a monomer, and emulsion polymerization by polymerizing an emulsified monomer in water using a water-soluble initiator. The polymerization method may be selected according to function.

In order for the polymer to be a part of or the whole of the binder comprising at least one layer of the outermost layer from the support, it is preferable to polymerize using emulsion polymerization in cases when the coating solvent employs water as a primary component, however, in cases when the coating solvent is an organic solvent as a primary component, the polymer may be polymerized employing solution polymerization using that solvent or with pearl polymerization, modified from suspension polymerization.

Of these, pearl polymerization is preferable, which produces a polymer in particle form employing the following steps; dispersion of a monomer mixing solution, in which is dissolved an initiator in a water medium, being at a size of about 1 mm in diameter; polymerization by adding heat; and further filtration and washing.

The thus obtained polymer may be provided as a part of or the whole of a binder after being dissolved in an organic solvent, and further, may possibly be added to a coating composition in which water is a primary component, after that being dissolved in a water-soluble organic solvent such as tetrahydrofuran, and this solution is dispersed into water, after which the organic solvent is removed under reduced pressure, and finally dispersed into water.

In the pearl polymerization method in this invention, it is preferable to employ a water-soluble polymer as a stabilizing agent, such as gelatin, polyvinyl alcohol, hydroxyethyl cellulose, polyvinylpyrrolidone, casein, starch, polyacrylic acid, and polymethacrylic acid. These are preferably within the range of 0.1–25 weight % in an aqueous suspension. In the pearl polymerization, an inorganic salt and a surface active agent may further be employed as a dispersing agent.

Examples of inorganic salts include monovalent metal salts such as sodium chloride and potassium chloride, divalent salts such as calcium chloride and calcium carbonate, and trivalent salt such as aluminum sulfate.

Examples of surface active agents include anionic surface active agents such as sodium dodecylbenzenesulfonate, polyoxyethylene alkyl ether sodium sulfate, polyoxyethylene phenyl ether sodium sulfate, and sodium dialkylsulfosuccinate; nonionic surface active agents such as polyoxyethylene alkyl ether and polyoxyethylene phenyl ether; anionic polymerizing surface active agents such as a sodium salt of (metha)acrylic polyoxyethylene sulfate, a sodium salt of alkylallylsulfosuccinate, and glyceroallylnony polyoxyethylene ammonium sulfate; nonionic polymerizing surface active agents such as polyoxyethylenealkylbenzen (netha) crylate, and glyceroallylnonylphenyl polyethylene glycol ether.

The polymerization initiator used in the pearl polymerization of this invention is preferably an oil soluble initiator which is soluble to a monomer, and employed may be oil soluble peroxides and azobis type compounds which are commonly used.

Examples of the foregoing compounds include 2,2'-azobis (2,4-dimethylvaleronitrile), 2,2'-azobis(isobutylnitrile), lauroyl peroxide, and benzoyl peroxide, of which lauloyl peroxide and benzoyl peroxide are preferred because no gas is generated during polymerization. Further, a chain transfer agent may be added to the monomer. The added amount of these oil soluble initiators is 0.1–10 mol % of the chosen monomer.

In this invention, a water-soluble polymerization initiator may be added to an aqueous solvent after formation of the polymer particles.

Examples of water-soluble polymerization initiators used in this invention include persulfates such as ammonium persulfate, sodium persulfate, and potassium persulfate; azo type initiators such as 2,2'-azobis(2-amidinopropane)dihydrochloride, 2,2'-azobis{2-(5-methyl-2-imidazoline-2-yl) propane}dihydrochloride, and 2,2'-azobis{2-(2-imidazoline-2-yl)propane}dihydrochloride. These may be employed alone or in combination of more than two, specifically however persulfates are preferable.

The added amount of the water-soluble polymerization initiator is preferably in the range of 0.01–1.0 weight % based on the total weight of the particle polymer.

In addition, as a suspension stabilizing agent, employed may be an anionic fine particle suspension stabilizing agent (such as silica, clay and talc), an anionic, cationic and nonionic surface active agent {such as (sulfonated) alkylaryl polyether, ethylene glycol ether of polyhydric alcohol, carboxyalkyl substituted polyglycol ether and carboxyalkyl substituted polyglycol ester, a sodium salt of a condensation product of naphthalenesulfonic acid and formaldehyde, phosphates of glycidole polyether, higher alcohol sulfates, aliphatic acid ester derivaties of sulfosuccinic acid, α-sulfo lower alkyl ester of a fatty acid, and a sulfate product of glycidole polyether}.

Of the polymerization conditions, the reaction temperature is preferably 50–90° C., and more preferably 55–85° C., however, initially prepolymerization is conducted at about 64° C. to form polymer particles, and then it is preferred to raise the temperature to 80° C. to complete polymerization of the residual monomer.

Next, tin oxide compounds will be detailed.

Examples of tin oxide compounds usable in this invention include tin oxide itself, antimony doped tin oxide, indium doped tin oxide, fluorine doped tin oxide, aluminum doped tin oxide, tungsten doped tin oxide, a complex of titanium oxide-cerium oxide-tin oxide, and a complex of titanium oxide-tin oxide.

Tin oxide is extremely pure, hyaline and crystalline tin oxide, having a tetragonal rutile type structure, and is known to exhibit a 1.9968 reflection index and a high resistance of more than $10^6$ Ωcm of electrical conductivity at room temperature. Further, its melting point is 1,127° C. However, amorphous tin oxide is a substance which does not exhibit the above characteristics, and does not exhibit a long-distance order in its atom arrangement, and further, is a tin oxide having a temperature region which shows changes of a substance lower than the melting point of crystalline tin oxide.

Tin oxide like this can be produced as follows. A production process of water dispersions containing tin oxide features a hydrolyzing treatment process of hydrolysable tin compounds and a washing process of that hydrolyzate. To obtain crystalline tin oxide, the obtained tin oxide sludge is dried and heated to more than 500° C. in an electric furnace or oven to crystallize. The crystallized tin oxide is dispersed into water using a mechanical dispersion method. In the case of amorphous tin oxide, dispersion can be conducted more easily than crystalline tin oxide, and is dispersed with pH adjustment during or after washing. In this case, the washing process and pH adjusting processes may be conducted at the same time. Further, the mechanical dispersion process may be conducted after the washing process or after the pH adjusting process. Further, this invention is not limited as above and each process may be further segmentalized.

A common raw material of tin oxide is a hydrolysable tin compound, and this is hydrolyzed to prepare amorphous tin oxide. Examples of tin compounds include compounds containing oxo anions such as $K_2SnO_3.3H_2O$; water-soluble halides such as $SnCl_4$, $SnCl_4.5H_2O$; compounds having a structure of $RSnR_{4-m}.R'_{4-m-n}.X_{4-m-n-p}$ (wherein, R represents an alkyl group or an aliphatic carboxyl group; R' represents an alkyloxy group, an ether group having an aromatic ring, an aliphatic carboxyl group, or a group having β-ketone ring; X represents a halogen atom; m represents 0–3; n represents 0–3; and p represents 0, 1 or 2). Specific examples of these compounds include tin chlorides such as stannous chloride, and stannic chloride; tin oxide; tin hydrate; organic salts or inorganic acid salts of tin (stannous salts or stannic salts) such as tin acetate, tin oxalate, tin sulfate, and tin nitrate; stannate alkaline salts such as potassium stannate, and sodium stannate; and organic tin compounds such as $(C_2H_5)_4Sn$, $(CH_3)_3SnOC_2H_5$, $(C_4H_9)_2SN(OCOC_2H_5)_2$, $(C_2H_5)_2SnCl_2$, and $(CH_3)_3SnCl.C_5H_5N$; as well as compounds containing an oxosalt such as $Sn(SO_4)_2.2H_2O$. These compounds may be used alone or in combinations of more than two. Of these, the use of hydrochloric acid solution of tin chloride is industrially preferable. Tin oxide can be obtained in a hydrolysis process by adding tin chlorides to water or a alkaline metal aqueous solution ruring preparation of tin oxide.

The added amount of the tin oxide compound in dispersions to obtain the foregoing electrical conductivity is preferably 35–80 weight %. Further, the added amount of the co-polymerized polyester is preferably 20–65 weight %, and the added amount of other components is preferably 0–15 weight %.

Next, the components comprising an image forming layer will be described.

Non-light sensitive aliphatic carboxylic silver salt (hereinafter, refers to as an aliphatic carboxylic acid silver salt).

The aliphatic carboxylic acid silver salts used in the invention are a reducible silver source, and silver salts of aliphatic carboxylic acid having 10–30 carbon atoms and more preferably 15–25 carbon atoms are preferred. Examples of preferred silver salts are listed below.

Examples of silver salts may be salts of gallic acid, oxalic acid, behenic acid, stearic acid, arachidic acid, palmitic acid and lauric acid. Of these, silver salts of behenic acid, arachidic acid and stearic acid are specifically preferred. Two or more kinds of aliphatic carboxylic acid silver salts may be mixed in this invention, and it is preferable that behenic acid silver salt is at least 80% of the total weight of the organic carboxylic acid silver salts.

An aliphatic carboxylic acid silver salt may be obtained by mixing a water-soluble silver compound with a compound capable of forming a complex with silver. A normal precipitation method, a reverse precipitation method, a double jet precipitation method and a controlled double jet precipitation method as described in JP-A 9-127643 are preferably employed. In this case, silver halide grains may be concurrently present.

The average circular equivalent diameter of the aliphatic carboxylic acid silver salt is preferably 0.05–0.8 μm, and the average thickness is preferably at least 0.005 μm, and the specifically preferable average circular equivalent diameter is 0.2–0.5 μm, at an average thickness of 0.01–0.05 μm.

Methods to prepare aliphatic carboxylic acid silver salt grains having the above-mentioned shape are not particularly restricted, however, the optimization of various conditions such as maintaining the mixing state during the formation of an organic acid alkali metal salt soap and/or the mixing state during the addition of silver nitrate to the soap are effective.

The aliphatic carboxylic acid silver salt grains preferably employed in this invention (this means the aliphatic carboxylic acid silver salt grains having the average circular equivalent diameter of 0.05–0.8 μm at an the average thickness of 0.005–0.07 μm) are preliminarily dispersed together with binders, surface active agents, as appropriate, and the resulting mixture is preferably dispersed and pulverized by a media homogenizer or a high pressure homogenizer. During the foregoing preliminary dispersion, ordinary stirrers such as an anchor type, a propeller type, and a high speed rotation centrifugal radial type stirrer (dissolver), as a high speed shearing stirrer (homomixer) may be employed.

It is preferable that a compound having the function and effect of miniaturizing and monodispersing in the production process of aliphatic carboxyl acid silver salt grains, the function and effect of which are exhibited much more effectively under the presence of this compound compared to the production without the presence of the compound. Examples of preferable compounds include monohydric alcohols having fewer than 10 carbon atoms, branched aliphatic carboxylic acids including isomers, aliphatic unsaturated carboxylic acids, complex carbohydrates, cellosolves, water-soluble organic solvents, and water-soluble polymers.

Light-sensitive Silver Halide Grains

The light-sensitive silver halide grains (hereinafter, also referred to as light-sensitive silver halide grains or simply silver halide grains) employed in the silver salt photothermographic dry imaging materials of this invention (hereinafter, referred to as photosensitive materials of this invention) will now be described. As well, the light-sensitive silver halide grain in this invention means the silver halide grain prepared so as to generate chemicophysical changes inside and/or on the surface of the silver halide crystal with absorption of any region of light of wave length from the ultra violet region through the infrared region, of which silver halide can naturally absorb light as a specific characteristic of silver halide crystals, or can absorb visible rays or infrared rays by artificial chemicophysical methods.

The silver halide grains themselves used in this invention can be prepared as an emulsion of the silver halide grains according to the methods described in Chimie Physique Photographique, by P. Glafkides (published by Paul Montel Corp., 19679); Photographic Emulsion Chemistry, by G. F. Duffin (published by Focal Press, 1966); and Making and Coating of Photographic Emulsion, by V. L. Zelkman, et al. (published by Focal Press, 1964).

More specifically, any one of an acidic precipitation, neutral precipitation and ammoniacal precipitation is applicable, and the reaction mode of aqueous silver salt and soluble halide salt includes single jet addition, double jet addition and a combination thereof. Specifically, preparation of silver halide grains while controlling the grain formation condition, so-called controlled double-jet precipitation, is preferred. The halide composition of silver halide is not specifically limited and may be any one of silver chloride, silver chlorobromide, silver iodochlorobromide, silver bromide, silver iodobromide or silver iodide, however, silver bromide and silver iodobromide are preferably employed for medical imaging materials. Iodide may be contained and evenly distributed in the total silver halide grains or distributed at certain portions of the silver halide grains, for example, as a core/shell structure in which the iodide concentration around the center of the grains is higher and that around the surface is lower or substantially zero.

Grain forming processes are usually classified into two stages of formation, silver halide seed crystal grains (nucleation) and grain growth. These stages may be continuously conducted, or the nucleation (seed grain formation) and grain growth may be separately performed. Controlled double-jet precipitation, in which grain undergoes formation while controlling grain forming conditions such as pAg and pH, is preferred to control the grain form and grain size.

Different diameter silver halide grains employed in this invention may preferably be mixed, and the amount of silver halide grains of at most 0.040 μm and/or 0.070–0.100 μm are to be in the range of 10–30% of the total, while grains less than 0.02 μm are not considered.

The grain size as described herein is defined as the edge length of silver halide grains, in cases where they are so-called regular crystals in the form of a cube or an octahedron. Further, in cases where silver halide grains are tabular grains, the grain size refers to the diameter of a circle having the same area as the projected area of the major face.

In this invention, the silver halide grains are preferably monodispersed grains.

The grain can be of almost any form, including cubic, octahedral or tetradecahedral grains, tabular grains, spherical grains, bar-like grains, and tuber-shaped grains. Of these, cubic grains, octahedral grains, tetradecahedral grains and tabular grains are specifically preferred.

In cases where tabular grains are employed, the aspect ratio of the tabular grains is preferably 1.5–100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of (100), for example, a high ratio accounted for by a Miller index (100) face is preferred. This ratio is preferably at least 50%, is more preferably at least 70%, and is still more preferably at least 80%. The ratio accounted for by the Miller index (100) face can be obtained based on T. Tani, J. Imaging Sci., vol. 29, pg. 165 (1985) in which adsorption dependency of a (111) face or a (100) face is utilized.

It is preferred to use low molecular gelatin having an average molecular weight of not more than 50,000 in the preparation of silver halide grains used in this invention, specifically, in the stage of nucleation.

The concentration of dispersion medium used in the nucleation stage is preferably not more than 5% by weight, and is more preferably as low a concentration as 0.05–3.0% by weight.

In the silver halide grains employed in this invention, it is preferred to use a polyethylene oxide compound in the nucleation stage.

Polyethylene oxide compounds have been employed as an antifoaming agent, and the polyethylene oxide compounds described in JP-A 44-9497 may also function as an antifoaming agent in the nucleation stage.

The concentration of the silver salt aqueous solution and the halide aqueous solution used in the nucleation stage is preferably at most 3.5 mol/l, and more preferably in the low range of 0.01–2.5 mol/l. The adding rate of the silver ions in the nucleation stage is preferably $1.5\times10^{-3}$–$3.0\times10^{-1}$ mol/min per little of the reaction solution, and more preferably $3.0\times10^{-3}$–$8.0\times10^{-2}$ mol/min.

The pH during nucleation may be within the range of 1.7–10, and since the pH at the alkaline end of the range broadens the grain size distribution, the pH is preferably 2–6.

In this invention, heterocyclic compounds may preferably be contained in the interior of the silver halide grains after nucleation from a speed and image storage stability point of view. Examples of such heterocyclic compounds used in this invention include imidazole, pyridine, pyrimidine, pyradine, pyridazine, triazole, triazine, thiadiazole, oxadiazole, quinoline, phthalazine, naphtylidine, quinoxaline, quinazoline, cinnoline, tetrazole, thiazole, oxazole, benzimidazole, benzoxazole, benathiazole, and tetrazaindene. Further, the foregoing heterocyclic compounds may have a substituent.

The silver halide grains of this invention may be incorporated into a light-sensitive layer (hereinafter, simply referred to a sensitized layer) by any appropriate means, in which the silver halide grains are preferably arranged to be as close to a reducible silver source (an aliphatic carboxylic acid silver salt) as possible.

It is common that the silver halide of this invention, which has been prepared in advance, is added to a solution used for preparing the aliphatic carboxylic acid silver salt grains. In this case, preparation of silver halide and of an organic silver salt are separately performed, making it easier to control the preparation thereof. Alternatively, as described in British Patent 1,447,454, silver halide and an aliphatic carboxylic acid silver salt grain may be formed at the almost same time by allowing a halide component such as a halide ion to be present together with an aliphatic carboxylic acid silver salt-forming component and by introducing silver ions thereto. Further, silver halide grains can also be prepared by reacting a halogen containing compound with an aliphatic carboxylic acid silver salt through conversion of the aliphatic carboxylic acid silver salt.

However, the light-sensitive silver halide grains of this invention means that the silver halide grains were separately prepared in advance from the foregoing aliphatic carboxylic acid silver salt, having no direct relationship with the foregoing aliphatic carboxylic acid silver salt.

The silver halide grain-forming components include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A Nos. 53-27027 and 53-25420. As described above, silver halide can be prepared by converting a part or all of an organic acid silver salt to silver halide through reaction of the organic acid silver salt and a halide ion. Further, the silver halide separately prepared may be used in combination with silver halides prepared by conversion of at least a part of aliphatic carboxylic acid silver salt.

Silver halide which is separately prepared or prepared through conversion of an aliphatic carboxylic acid silver salt is preferably used in an amount of 0.001–0.7 mol, and more preferably 0.03–0.5 mol per mol of the aliphatic carboxylic acid silver salt.

The silver halide grains used in this invention preferably contain ions of transition metals belonging to Groups 6–11 of the Periodic Table.

These metal compounds can be dissolved in water or a suitable organic solvent (such as alcohols, ethers, glycols, ketones, esters, amides) and then added. Furthermore, there are methods in which, for example, an aqueous metal compound powder solution or an aqueous solution in which a metal compound is dissolved along with NaCl and KCl is added to a water-soluble silver salt solution or to a water-soluble halide solution during grain formation; when a silver salt solution and a halide solution are simultaneously added, a metal compound may be added as a third solution to form silver halide grains, while simultaneously mixing the three solutions; during grain formation, an aqueous solution comprising the necessary amount of a metal compound may be added into a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be added into a reaction vessel immediately after grain formation, or during physical ripening or at the completion thereof or during chemical ripening.

The separately prepared silver halide grains may be desalted using the methods commonly known in the photographic industry, such as a noodle washing method, a flocculation process, an ultrafiltration method and an electrodialysis method.

Further, in this invention, the diameter of the silver halide grains may optionally be controlled by the methods commonly known in the photographic industry, such as changing the temperature or the duration of the growing period after nucleation.

Silver Ion Reducing Agent

As a silver ion reducing agent used in this invention, a bisphenol derivative compound is preferably employed.

In the present invention, at least one silver ion reducing agent of a bisphenol derivative compound may be employed alone or together with other reducing agents having a different chemical structure, resulting in unexpected reduction of degradation by fogging increases during storage of the photothermographic material of this invention and degradation of the silver image color tone over time.

In this invention, employed as silver ion reducing agents are polyphenol compounds described in U.S. Pat. Nos. 3,589,903 and 4,021,249, British patent No. 1,486,148, JP-A Nos. 51-51933, 50-36110, 50-116023 and 52-84727, JP-B 51-35727 (hereinafter, the term, JP-B means examined Japanese Patent Publication); bisnaphthols described in U.S. Pat. No. 3,672,904; sulfonamidophenols and sulfonamidonaphthols described in U.S. Pat. No. 3,801,321.

The amount of a reducing agent to be used is preferably $1\times10^{-2-10}$ mol, and more preferably $1\times10^{-2-1.5}$ mol per mol of silver.

The amount of the reducing agent used in the photothermographic dry imaging material of this invention is variable depending on the kinds of organic silver salts or reducing agents and other additives, but is usually 0.05–10 mol, and preferably 0.1–3 mol per mol of the organic silver salt. Two or more reducing agents may be used in combination, in an amount within the foregoing range. In the present invention, addition of the foregoing reducing agent to a light-sensitive emulsion comprising a light-sensitive silver halide, organic silver salt grains and a solvent immediately before coating the emulsion is often preferred, thereby minimizing variation in photographic performance during storage.

Two or more reducing agents may be used in combination. In the present invention, addition of the reducing agent to a light sensitive emulsion comprising a light sensitive silver halide, organic silver salt grains and a solvent immediately before coating the emulsion is often preferred, thereby minimizing variation in photographic performance during storage.

Further, it is preferred to employ a compound which can form a hydrogen bond with a hydrogen of a hydroxyl group in the reducing agent, such as triphenylphosphinoxide described in EP 1,096,310, as a coadjuvant of the reducing agent.

Binder

Binders suitable for the photothermographic dry imaging materials of this invention are transparent or translucent and generally colorless, including natural polymers, synthetic resins, polymers or copolymers and film forming mediums. Examples thereof include gelatin, gum Arabic, (poly)vinyl alcohol, hydroxyethyl cellulose, cellulose acetate, cellulose acetate butyrate, (poly)vinyl pyrrolidone, casein, starch, (poly)acrylic acid, (poly)methyl methacrylate, (poly)vinyl chloride, (poly)methacrylic acid, copoly (styrene-anhydrous maleic acid), copoly (styrene-acrylonitrile), copoly (styrene-butadiene), polyvinyl acetals (e.g., polyvinyl formal, polyvinyl butyral), polyesters, polyurethanes, phenoxy resin, poly(vinylidene chloride), poly(epoxides), poly(carbonates), poly(vinyl acetate), cellulose esters, and poly(amides). These may be hydrophilic or hydrophobic.

Of these, polyvinyl acetals are preferred as a binder used for the light-sensitive layer of the photothermographic dry imaging material of this invention, and polyvinyl butyral is a specifically preferred binder. The details for this preference are given later. Further, for a non-light-sensitive layer such as an over-coating layer or a sublayer, specifically, a protective layer or a back coating layer, preferred are cellulose esters exhibiting a relatively high softening temperature, such as triacetyl cellulose and cellulose acetate-butyrate. The foregoing binders may optionally be used in combination.

A binder must be used in an amount within the effective range to function as a binder.

In the polymer containing layers of this invention, the foregoing polymer of this invention may be employed, and the amount of the polymer may be at most 30% of the total binders, and preferably within the range of 0.1–15%. The foregoing binders may be employed as a binder used in combination with the polymer of this invention.

Cross-linking Agent

It is commonly known that the use of a cross-linking agent in such a binder as described above improves layer adhesion and lessens unevenness during development, however, in this invention, there are also effects of fogging reduction during storage and of print-out silver formation reduction after development.

Cross-linking agents usable in this invention include various commonly known cross-linking agents used for silver halide photographic sensitized materials, such as an aldehyde type, epoxy type, ethyleneimine type, vinylsulfone type, sulfonate type, acryloyl type, carbodiimide type and silane compound type cross-linking agents, as described in JP-A 50-96216.

In this invention, such cross-linking agents may be incorporated into any optional layer on the light-sensitive layer-side of the support, for example, a light-sensitive layer, surface protective layer, interlayer, antihalation layer or a sublayer. Thus it may be incorporated into one or a plurality of these layers.

Toning Agent

It is preferred to employ a toning agent in the silver salt photothermographic dry imaging material of this invention. Exemplary preferred toning agents are described in RD (Research Disclosure) 17029, U.S. Pat. Nos. 4,123,282, 3,994,732, 3,846,136 and, 4,021,249. Specifically preferred toning agents include phthalazinone, a combination of phthalazine, and phthalic acids or phthalic acid anhydrides.

Specifically in this invention, it is preferred to incorporate a compound having a carboxyl group in the non-light sensitive layer adjacent to the light-sensitive layer, such as phthalic acid, 4-methylphthalic acid, 4-nitrophthalic acid, tetrachlorophthalic acid anhydride, benzoic acid, 4-methylbenzoic acid, 4-nitrobenzoic acid, and pentachlorobenzoic acid. More preferably, the compound is to be contained in the non-light sensitive layer opposite the support on the light-sensitive layer side.

The added amount of the compound having a carboxyl group in the non-light sensitive layer is preferably 0.005–0.20 mol/mol of Ag, and more preferably 0.01–0.10 mol/mol of Ag.

With regard to image tone of output images used for medical diagnosis, it has been assumed that more exact diagnostic observation results can be easily achieved with cold image tones for an interpreter of X-ray images. A cold image tone refers to a pure black or bluish black tone and a warm image tone refers to a brownish black image.

Anti-Fogging Agent and Image Stabilizing Agent

As a reducing agent used in the silver salt photothermographic dry imaging materials of this invention, mainly employed may be reducing agents such as bisphenols, to be described later. Accordingly, a compound generating a labile species which is capable of abstracting a proton to deactivate the reducing agent is preferably contained in the photothermographic materials. More preferable is a compound as a non-colored photo-oxidizing substance, which is capable of generating a free radical as a labile species on exposure.

Consequently, any compound having such a function is applicable, and an organic free radical composed of plural atoms is preferred. Any compound having such a function and exhibiting no adverse effect on the silver salt photothermographic dry imaging material is usable, irrespective of its structure.

Further, of such free radical generation compounds, a compound containing an aromatic, and carbocyclic or heterocyclic group is preferred, which provides stability to the generated free radical if in contact with the reducing agent for a period sufficient to deactivate the reducing agent.

Representative examples of such compounds include biimidazolyl compounds and iodonium compounds as described below. For example, biimidazolyl compounds can be synthesized in accordance with the methods described in U.S. Pat. No. 3,734,733 and British Patent 1,271,177.

Specifically preferable examples include compounds described in JP-A 2000-321711.

Also, iodonium compounds are cited as preferred compounds. Iodonium compounds can be synthesized in accordance with methods described in Org. Syn., (John Wiley & Sons, 1961) and Fieser, "Advanced Organic Chemistry" (Reinhold, N.Y., 1961).

Specifically preferable examples are described in JP-A 2000-321711.

The added amount of these compounds is $10^{-3}$–$10^{-1}$ mol/m$^2$, and more preferably $5\times10^{-3}$–$5\times10^{-2}$ mol/m$^2$. The compound may be incorporated into any component layer of the photosensitized material related to the invention, and is preferably incorporated in the vicinity of a reducing agent.

As a compound capable of deactivating a reducing agent to inhibit reduction of an aliphatic carboxylic acid silver salt to silver by the reducing agent, preferred are compounds releasing a labile species, other than a halogen atom. However, these compounds may be used in combination with a compound capable of releasing a halogen atom as a labile species. Also known are many compound generating a halogen atom as a labile species and their combined use results in superior desired effects.

Examples of the compounds releasing an active halogen atom include compounds of 4-1 through 4-64 described in JP-A 2001-249428.

The added amount of these compounds is preferably within the range in which an increase of printed-out silver caused by formation of silver halide becomes substantially negligible, but preferably at most 150% by weight and more preferably at most 100% by weight, based on the compound releasing no active halogen radical.

Further, in addition to the foregoing compounds, compounds commonly known as anti-fogging agents may be incorporated in the silver salt photothermographic dry imaging material of this invention. In such cases, the compounds may be such which form a labile species similarly to the foregoing compounds or those which differ in antifogging mechanism. Examples thereof include compounds described in U.S. Pat. Nos. 3,589,903, 4,546,075, and 4,452,885; JP-A 59-57234; U.S. Pat. Nos. 3,874,946 and 4,756,999; and JP-A Nos. 9-288328 and 9-90550. Further, other anti-fogging agents include, for example, compounds described in U.S. Pat. No. 5,028,523 and European Patent Nos. 600,587, 605,981 and 631,176.

Thiosulfonic acid compounds may be combined with the foregoing compounds within the range which do not impair effects of this invention.

Chemical Sensitization

Silver halide grains used in this invention can be subjected to chemical sensitization in accordance with methods described in JP-A Nos. 2001-249428 and 2001-249426, for example, a chemical sensitization center (chemical sensitization speck) can be formed using compounds capable of releasing chalcogen such as sulfur, selenium or tellurium, or noble metal compounds capable of releasing a noble metal ion such as a gold ion. In this invention, it is specifically preferred to conduct chemical sensitization with an organic sensitizer containing a chalcogen atom. These organic sensitizers include, for example, those having various structures, as described in JP-A Nos. 60-150046, 4-109240 and 11-218874.

In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can be also conducted by ripening the emulsion while maintaining a pH of not less than 7 or a pAg of not more than 8.3.

Silver halide to be subjected to chemical sensitization may be any one which has been prepared in the presence of an organic silver salt, one which has been formed under the condition in the absence of an organic silver salt, or a combination thereof.

Spectral Sensitization

The light-sensitive silver halide grains used in this invention are preferably subjected to spectral sensitization by allowing a spectral sensitizing dye to adsorb onto the grains. Examples of the spectral sensitizing dyes include spectral sensitizing dyes described in JP-A Nos. 63-159841, 60-140335, 63-231437, 63-259651, 63-304242, and 63-15245; U.S. Pat. Nos. 4,639,414, 4,740,455, 4,741,966, 4,751,175 and 4,835,096. Useful sensitizing dyes used in this invention are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners.

In this invention, it is also preferable to use sensitizing dyes having spectral sensitivity within the infrared region. Examples of such preferred infrared sensitizing dyes include those described in U.S. Pat. Nos. 4,536,473, 4,515,888 and 4,959,294.

In this invention, the foregoing spectral sensitizing dyes may be used alone or in combinations thereof. The combined use of sensitizing dyes is often employed for the purpose of super spectral sensitization.

Super Spectral Sensitizing Agents

A super spectral sensitizing agent, such as a dye which does not exhibit spectral sensitization or a substance which does not substantially absorb visible light may be incorporated, in combination with a sensitizing dye, into the emulsion containing silver halide and an aliphatic carboxylic acid silver salt used in the silver salt photothermographic dry imaging materials of this invention.

Useful sensitizing dyes, dye combinations exhibiting super sensitization and materials exhibiting super spectral sensitization are described in RD 17643 (December, 1978), section IV-J in page 23, JP-B 9-25500 (herein, the term, JP-B means examined Japanese Patent Publication) and JP-A 59-19032, 59-192242 and 5-341432.

Exposure Methods

In the invention, exposure is preferably conducted by laser scanning exposure and various methods are applicable to its exposure.

When a photothermographic material is scanned with laser light, the beam spot diameter on the surface of the photosensitive material is preferably not more than 200 μm, and more preferably not more than 100 μm, since the smaller spot diameter preferably reduces the angle from a non-perpendicular laser incident angle. The lower limit of the beam spot diameter is 10 μm. The thus configured laser scanning exposure can reduce deterioration in image quality due to reflected light, such as occurrence of fringe-like interference unevenness.

In the second preferred exposure method, exposure applicable in this invention is conducted preferably using a laser scanning exposure apparatus producing longitudinally multiple scanning laser light.

In the foregoing first and second preferred embodiments of the image recording method of this invention, lasers for scanning exposure include, for example, semiconductor lasers, chemical lasers, and dye lasers, which are optimally selected. Of these, semiconductor lasers are preferred in terms of maintenance and the size of the light source. When exposed onto the silver salt photothermographic dry imaging material in a laser imager or laser image-setter, the beam spot diameter on the exposed surface is to be within the range of 5–75 μm as the minor axis diameter and 5–100 μm as the major axis diameter.

Thermal Development Method

The developing conditions for photographic materials in the invention are variable, depending on the instruments or apparatus used and the application means, and which typically accompany heating the imagewise exposed silver salt photothermographic dry imaging material at an optimal high temperature. Latent images formed upon exposure are developed by heating the silver salt photothermographic dry imaging material at an intermediate high temperature (e.g., 100–200° C.) over an ample period of time (generally, ca. 1–2 min.). An oxidation-reduction reaction between an aliphatic carboxylic acid silver salt (functioning as an oxidation agent) and a reducing agent results upon heating to form silver images. The reaction process proceeds without supplying any processing solution such as water from outside the system.

Heating instruments, apparatuses and means include typical heating means such as a hot plate, hot iron, hot roller or a heat generator employing carbon or white titanium. It is much preferred to conduct thermal processing during transportation, while bringing the protective layer into contact with a heated roller.

Matting Agent

In the present invention, a matting agent is preferably incorporated into the surface layer of the silver salt photothermographic dry imaging material (on the light-sensitive layer side or even in cases where a light-insensitive layer is provided on the opposite side of the support to the light-sensitive layer), in order to minimize problematic handling before thermal development and image abrasion after thermal development. The polymer of this invention or a usual polymer may be employed as a matting agent. The added amount of the matting agent is preferably 0.1–30% by weight of the binder.

Support

Suitable supports used in the silver salt photothermographic dry imaging materials of the invention include various polymeric materials, glass, wool fabric, cotton fabric, paper, and metals (such as aluminum). Flexible sheets or materials to be convertible to roll form are preferred from the viewpoint of information recording materials. Examples of preferred supports used in the silver salt photothermographic dry imaging materials of this invention include plastic films (such as cellulose acetate film, polyester film, polyethylene terephthalate film, polyethylene naphthalate film, polyamide film, polyimide film, cellulose triacetate film and polycarbonate film). Biaxially stretched polyethylene terephthalate film is specifically preferred in this invention. The support thickness is commonly about 50–300 μm, and is preferably 70–180 μm.

Other Factors

The silver salt photothermographic dry imaging material of this invention comprises at least one light-sensitive layer on a support. Only a light-sensitive layer may be provided on the support, however, it is preferable to provide at least one non-light sensitive layer further thereon. For example, a protective layer is preferably provided on the light-sensitive layer to protect the light-sensitive layer, and on the opposite side of the support to the light-sensitive layer, a back coating layer (referred to simply a back layer) is preferably provided to prevent adhesion between photosensitized materials or within rolls of the photosensitized materials. Binders used in the protective layer or back coating layer are preferably selected from polymers which have a glass transition point higher than that of the thermally developable layer, and are resistant to abrasion or deformation, such as cellulose acetate and cellulose acetate-butylate. To adjust contrast, two or more light-sensitive layers may be provided on one side of the support, or one or more layers may be provided on both sides of the support.

In this invention, it is specifically preferable to use the polymers of this invention in the back coating layer, and is also preferable to use the polymer of this invention in the protective layer, as appropriate.

It is preferred to form a filter layer on the same side as or on the opposite side of the light-sensitive layer, or to allow a dye or pigment to be contained in the light-sensitive layer to control the amount or wavelength distribution of light transmitted through the light-sensitive layer of the silver salt photothermographic dry imaging materials related to this invention.

Commonly known compounds exhibiting absorption over various wavelength regions can be used as a dye, in response to spectral sensitivity of the photosensitized material.

In cases where the silver salt photothermographic dry imaging material related to this invention are applied as an image recording material using infrared light, preferred is the use of squarilium dye containing a thiopyrylium nucleus, squarilium dye containing a pyrylium nucleus, thiopyrylium chroconium dye similar to squarilium dye or pyrylium chroconium dye.

A compound containing a squarilium nucleus may be a compound having a 1-cyclobutene-2-hydroxy-4-on in the molecular structure, and a compound containing a chroconium nucleus is a compound having a 1-cyclopentene-2-hydroxy-4,5-dion in the molecular structure, in which the hydroxyl group may be dissociated. Further, the compounds described in JP-A 8-201959 are also preferably used as such dyes.

Materials used in respective constituent layers are dissolved or dispersed in solvents to prepare coating compositions, plural coating compositions of which are simultaneously coated to form multi-layers on the support and further subjected to a heating treatment to form the silver salt photothermographic dry imaging material of this invention. "Plural coating compositions are simultaneously coated to form multi-layers" refers to coating compositions for respective constituent layers (for example, a light-sensitive layer, or a protective layer) and coating and drying are not repeated for respective layers but plural layers are simultaneously coated and dried to form respective constituent layers. The upper layer is provided before the remaining amount of total solvents in the lower layer reaches 70 weight % or less.

Methods for simultaneously coating plural constituent layers are not specifically limited and commonly known methods, such as a bar coating method, curtain coating method, dip coating method, air-knife method, hopper coating method and an extrusion coating method are applicable. Of these, extrusion coating, that is, pre-measured type coating is preferred. Extrusion coating is suitable for accurate coating or organic solvent coating since no evaporation occurs on the slide surface, as in a slide coating system. This coating method is applicable not only to the light-sensitive layer side but also in cases when simultaneously coating a back coating layer on the subbing layer.

EXAMPLES

The present invention will be further described below based on examples.

Example 1

Pearl Polymerization

PA-1

13.38 g (61.4 mmol) of 2,2,3,3,3-pentafluoropropylmethacrylate (product name: M-1210, produced by Daikin Industries, Ltd.), 12.27 g (61.4 mmol) of 2,2,3,3-tetrafluoropropylmethacrylate (product name: M-5210, produced by Daikin Industries, Ltd.), and 36.82 g (368.2 mmol) of methyl methacrylate (hereinafter, referred to as MMA) were mixed, and then 42.61 g (6.55 mmol) of a polymerization initiator of lauryl peroxide (hereinafter, referred to as LPO) was dissolved in the mixed monomers. Then, 187.5 g of water and 3.75 g of polyvinyl pyrrolidone (average molecular weight: 40,000, hereinafter, referred to as PVP), and 4.1 g of sodium chloride (hereinafter, referred to as NaCl) were added to a 0.5 liter round bottom flask with necks for a thermometer, a reflux condenser tube, a nitrogen blowing inlet, and a mixing blade (being a crescent wing of 5 cm diameter Teflon® blade) and dissolved while stirred at 300 rpm, and further added was the mixture solution of the monomers and the polymerization initiator stirred and blown nitrogen gas for 10 min. Confirming that the droplets rotated stably at a size of about 1 mm, the temperature was raised to 64° C. and allowed to react for 2 hours. After the temperature was lowered to room temperature, the contents were moved into 5 L of water. The obtained polymer beads were about ϕ1 mm and were washed with water by decantation until electrical conductivity of supernatant liquid became at most 0.8 μS/cm.

After washing, the polymer beads were filtered with a wire gauge of 0.2 mm pore diameter. Then, the polymer beads were poured into a beaker filled with 300 ml of ethanol, and again filtered with the 0.2 mm wire gauge after stirring and washed for 10 min. After ethanol was sufficiently removed, the polymer beads were dried at once in a drying box at 40° C.

PA-2 through PA-15 were similarly polymerized based on the methods described in Table 1. Each of the obtained substances were almost the same weight as the weight of the added monomers, and dissolved in methyl ethyl ketone without insolubles, leading to what is assumed to be the same copolymerized components as the preparation.

Incidently, the abbreviations in the table without explanation in PA-1 are given below.

R-1420: 2-(perfluorobutyl)ethyl acrylate, a product name of Daikin Industries, Ltd.

CHMA: cyclohexylmethacrylate

GMA: glycidylmethacrylate

Comparative Polymer

PA-16: a copolymer containing no hydrophobic monomers was polymerized using PA-14 components.

PA-17: a copolymer containing no fluorine containing acrylate was polymerized using PA-14 components.

TABLE 1-a

| | Reaction Condition | | | | | |
|---|---|---|---|---|---|---|
| | Reaction 1 | | Reaction 2 | | | |
| Sample No. | Temperature ° C. | Time Hr | Temperature ° C. | Time Hr | Stirring rpm | Scale g |
| PA-1 | 64 | 2 | 80 | 2 | 250 | 250 |
| PA-2 | 64 | 2 | 80 | 2 | 300 | 250 |
| PA-3 | 64 | 2 | 80 | 2 | 300 | 250 |
| PA-4 | 64 | 2 | 80 | 2 | 300 | 250 |
| PA-5 | 64 | 2 | 80 | 2 | 300 | 250 |
| PA-6 | 64 | 2 | 80 | 2 | 300 | 250 |
| PA-7 | 64 | 2 | 80 | 3 | 300 | 250 |
| PA-8 | 64 | 2 | 80 | 3 | 300 | 250 |

| | Added Amount | | | | | | | | | |
|---|---|---|---|---|---|---|---|---|---|---|
| | Monomer | | | | | | Initiator | | Stabilizing Agent | |
| | MMA | | M-5210 | | M-1210 | | LPO | | | |
| Sample | 100 | | 200 | | 218 | | 399 | | PVP | NaCl |
| No. | g | mmol | g | mmol | g | mmol | g | mmol | g | g |
| PA-1 | 36.82 | 368.2 | 12.27 | 61.4 | 13.38 | 61.4 | 2.61 | 6.55 | 3.75 | 4.1 |
| PA-2 | 41.1 | 410.5 | 10.3 | 51.3 | 11.2 | 51.3 | 2.73 | 6.84 | 3.75 | 4.1 |
| PA-3 | 30.5 | 305.4 | 15.3 | 76.5 | 16.7 | 76.5 | 2.44 | 6.11 | 3.75 | 4.1 |
| PA-4 | 20.2 | 202.3 | 20.2 | 101.1 | 22.0 | 101.1 | 2.15 | 5.39 | 3.75 | 4.1 |
| PA-5 | 12.1 | 120.7 | 24.1 | 120.7 | 26.3 | 120.7 | 1.93 | 4.83 | 3.75 | 4.1 |
| PA-6 | 8.6 | 86.0 | 25.8 | 129.0 | 26.1 | 129.0 | 1.83 | 4.59 | 3.75 | 4.1 |
| PA-7 | 36.5 | 364.5 | 4.9 | 24.3 | 21.2 | 97.2 | 2.59 | 6.48 | 3.75 | 4.1 |
| PA-8 | 37.2 | 372.3 | 19.9 | 99.3 | 5.4 | 24.8 | 2.64 | 6.62 | 3.75 | 4.1 |

TABLE 1-b

| | Reaction Condition | | | | | |
|---|---|---|---|---|---|---|
| | Reaction 1 | | Reaction 2 | | | |
| Sample No. | Temperature ° C. | Time Hr | Temperature ° C. | Time Hr | Stirring rpm | Scale g |
| PA-9 | 64 | 2 | 80 | 3 | 300 | 250 |
| PA-10 | 64 | 2 | 80 | 3 | 300 | 250 |
| PA-11 | 64 | 3 | 80 | 2 | 300 | 250 |
| PA-12 | 64 | 3 | 80 | 2 | 300 | 250 |
| PA-13 | 64 | 3 | 80 | 2 | 300 | 250 |
| PA-14 | 64 | 3 | 80 | 2 | 300 | 250 |
| PA-15 | 64 | 3 | 80 | 2 | 300 | 250 |
| PA-16 | 64 | 3 | 80 | 2 | 300 | 250 |
| PA-17 | 64 | 3 | 80 | 2 | 300 | 250 |

TABLE 1-b-continued

| Sample | Added Amount | | | | | | | | | |
|---|---|---|---|---|---|---|---|---|---|---|
| | Monomer | | | | | | Initiator | | Stabilizing Agent | |
| | R-1420 | | CHMA | | GMA | | LPO | | | |
| | 318 | | 168 | | 142 | | 399 | | PVP | NaCl |
| No. | g | mmol | g | mmol | g | mmol | g | mmol | g | g |
| PA-9 | 6.5 | 20.5 | 31.0 | 154.9 | 0.0 | 0.0 | 0.93 | 2.34 | 3.75 | 41 |
| PA-10 | 12.0 | 37.9 | 25.5 | 127.3 | 0.0 | 0.0 | 0.88 | 2.20 | 3.75 | 41 |
| PA-11 | 14.5 | 45.6 | 23.0 | 115.0 | 0.0 | 0.0 | 0.85 | 2.14 | 7.5 | 41 |
| PA-12 | 18.2 | 57.3 | 19.3 | 96.3 | 0.0 | 0.0 | 0.82 | 2.05 | 7.5 | 41 |
| PA-13 | 24.5 | 77.2 | 13.0 | 64.8 | 0.0 | 0.0 | 0.76 | 1.89 | 11.25 | 41 |
| PA-14 | 29.7 | 46.2 | 7.8 | 100.9 | 0.0 | 0.0 | 0.85 | 2.12 | 11.25 | 20.5 |
| PA-15 | 18.5 | 93.3 | 16.6 | 39.1 | 2.6 | 11.4 | 0.81 | 2.03 | 7.5 | 20.5 |
| PA-16 | 33.1 | 104.0 | 0.0 | 0.0 | 0.0 | 0.0 | 0.55 | 1.39 | 11.25 | 20.5 |
| PA-17 | 0.0 | 0.0 | 33.2 | 166.0 | 0.0 | 0.0 | 0.99 | 2.48 | 11.25 | 20.5 |

Example 1

Support with a Subbing Layer (1) Preparation of Support

Using terephthalic acid and ethylene glycol, PET of IV=0.66 (being measured in phenol/tetrachloroethane=6/4 (weight ratio) at 25° C. was prepared according to a common procedure. After pelletized, this PET was dried to crystallize at 130° C. for 4 hrs., and then, a blue dye was added to achieve a support density 0.185. After melting and blending at 300° C., the PET was extruded from a T type die and quickly cooled to prepare a non-drawn sheet of about 1.9 mm thickness. This film was subjected to longitudinal drawing at a factor of 3.3 at 110° C. using rollers of different peripheral velocity, and then, subjected to lateral drawing at a factor of 3.5 at 130° C. using tenter hooks, and further to relaxation in the lateral direction in 4%. After quick cooling, this support was slit at chucked portions by the tenter, then subjected to embossing, and wound up at 4.8 Kg/cm$^2$ to obtain a blue tinted 175 μm support.

(2) Subbing Coating

After a corona discharge treatment at 8V·A·min/m$^2$ was applied to surface "a" of the support, following which, subbing layer coating composition A was provided onto surface "a" to achieve a dry layer thickness of 0.2 μm, and further, a corona discharge treatment at 8V·A·min/m2 was similarly applied to the upper layer of surface "a", and following that subbing layer coating composition B was provided to achieve a dry layer thickness of 0.1 μm. Further, after the other side of surface "b" was also subjected to a corona discharge treatment at 8V·A·min/m$^2$, subbing layers were provided thereon in a specific order using the following subbing layer coating compositions C and D so that each dry layer had a thickness of 0.4 μm and 0.2 μm respectively. Thereafter, a heat treatment was conducted at 145° C. for 3 min in a heating treatment type oven having a film transport apparatus provided with plural rolls.

Subbing Layer Coating Composition A 53 g of a polymer latex solution (solid content of 30%) comprising 40 mol % of n-butyl acrylate, 24 mol % of styrene and 36 mol % of glycidyl methacrylate, 0.6 g of a surface active agent (UL-1) and 5 g of 10% aqueous solution of methyl cellulose were mixed and brought to 1,000 ml with water to prepare subbing layer coating composition A.

Surface Active Agent (UL-1)

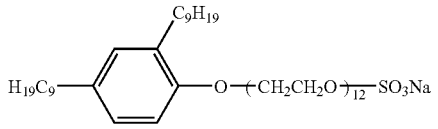

Subbing Layer Coating Composition B 5.3 g of a polymer latex aqueous solution (solid content of 30%) comprising 9 mol % of n-butyl acrylate, 33 mol % of t-butyl acrylate, 31 mol % of styrene and 26 mol % of 2-hydroxyethyl methacrylate; 288 g of aqueous solution of polyvinyl alcohol (product name: RS-2117, produced by Kuraray Co., Ltd.); and 0.6 g of a surface active agent (UL-1) were mixed. Further, 1.3 g of silica particles (SYLOID 350, produced by Fuji Silysia Chemical Ltd.) were added to 100 g of water to be dispersed using an ultrasonic dispersing apparatus (Ultrasonic Generator, frequency: 25 kHz, 600 W, manufactured by ALEX Corp.) for 30 min. This dispersion solution was added to the above mixture and brought to 1,000 ml with water to prepare subbing layer coating composition B.

Subbing Layer Coating Composition C 37.5 g of an amorphous stable colloidal solution containing tin oxides (CERAMACE S-8, produced by Taki Chemical Co., Ltd.); 3.7 g of a polymer latex solution (solid content of 30%) comprising 9 mol % of n-butyl acrylate, 33 mol % of t-butyl acrylate, 31 mol % of styrene and 26 mol % of 2-hydroxyethyl methacrylate; 14.8 g of a polymer latex solution (solid content of 30%) comprising 40 mol % of n-butyl acrylate, 24 mol % of styrene 36 mol % of glysidyl methacrylate; 0.1 g of a surface active agent (UL-1); and 5 g of 10% aqueous solution of methyl cellulose were mixed and brought to 1,000 ml with water to prepare subbing layer coating composition C.

Subbing Layer Coating Composition D 88.5 g of an aqueous dispersion solution (solid content of 18%)of acrylate modified polyester {acrylate component part (methyl methacrylate-ethyl acrylate-glycidyl methacrylate)/polyester component part (product name: PWS-2, produced by Kanebo Gohsen, Ltd.)=⅕} and 0.6 g of surface active agent (UL-1) were mixed. Further, 1.3 g of silica particles (SYLOID 350, produced by Fuji Silysia Chemical Ltd.) were added to 100 g of water to be dispersed using an ultrasonic dispersing apparatus (Ultrasonic Generator, frequency: 25 kHz, 600 W, manufactured by ALEX Corp.) for 30 min. This dispersion solution was added to the above mixture and brought to 1,000 ml with water to prepare subbing layer coating composition D.

Coating Composition of Back Coating Layer (1)

While stirring 830 g of methyl ethyl ketone (MEK), 75.8 g of cellulose acetate propionate (CAP 482-20, produced by Eastman Chemical Company) and 4.5 g of polyester resin (Vitel PE 2200B, produced by Bostic Corp.) were added and subsequently dissolved. Following that, to the dissolved solution added was 0.30 g of infrared dye 1, and further added were 4.5 g of fluorinated surface active agent (Surflon KH 40, produced by Asahi Glass Company) dissolved in 43.2 g of methanol and 8.42 g of each polymer PA-1 through 13, or PA-15, of this invention, while stirring until sufficiently dissolved. Finally, to the thus produced solution, added was 75 g of silica (SYLOID 64×6000, produced by W. R. Grace & Co.) dispersed in methyl ethyl ketone at a concentration of 1 weight % using a dissolver type homogenizer and stirred to prepare coating compositions of back coating layers 1 through 13 and 15.

Coating Composition of Back Coating Layer (2)

Coating composition 14 was prepared in the same manner as the coating composition of back coating layer (1) except that cellulose acetate propionate was changed to 80 g and polymer PA-14 of this invention was changed to 4.2 g.

Coating Composition of Back Coating Layer (3)

Coating compositions 16 and 17 were prepared in the same manner as coating composition of back coating layer (2) except that polymer PA-15 in the coating composition was changed to comparative polymers PA-16 and PA-17, the comparative compounds.

Coating Composition of Back Coating Layer (4)

While stirring 830 g of methyl ethyl ketone (MEK), 84.2 g of cellulose acetate propionate (CAP 482-20, produced by Eastman Chemical Company) and 4.5 g of polyester resin (Vitel PE 2200B, produced by Bostic Corp.) were added and allowed to dissolve. Subsequently, to the dissolved solution, added was 0.30 g of infrared dye 1, and further added were 4.5 g of fluorinated surface active agent (Surflon KH 40, produced by Asahi Glass Company) dissolved in 43.2 g of methanol while stirring until sufficiently dissolved. Finally, to the thus produced solution, added was 75 g of silica (SYLOID 64×6000, produced by W. R. Grace & Co.) dispersed in methyl ethyl ketone at a concentration of 1 weight % using a disolver type homogenizer and stirred to prepare coating composition of back coating composition 18.

Infrared Dye 1

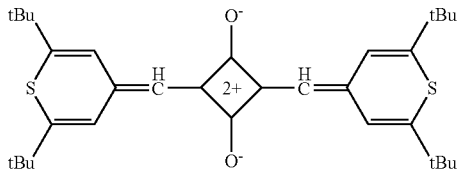

The thus prepared coating compositions of back coating layers 1 through 18 were coated and dried onto surface "b" using an extrusion coater to achieve a dry thickness of 3.5 μm. Drying was conducted by applying dry air at a temperature of 100° C. and a dew point of 10° C. for 5 min. The following light-sensitive layer was applied onto the opposite side of surface "b" to prepare samples 1 through 18.

Preparation of Light-sensitive Silver Halide Emulsion

| | |
|---|---|
| Solution (A1) | |
| Phenylcarbamoyl gelatin | 88.3 g |
| Compound (K) (10% methanol solution) | 10 ml |
| Potassium bromide | 0.32 g |
| Water to make | 5,429 ml |
| Solution (B1) | |
| 0.67 mol/l aqueous silver nitrate solution | 2,635 ml |
| Solution (C1) | |
| Potassium bromide | 51.55 g |
| Potassium iodide | 1.47 g |
| Water to make | 660 ml |
| Solution (D1) | |
| Potassium bromide | 154.9 g |
| Potassium iodide | 4.41 g |
| Osmium chloride | 0.93 ml |
| Water to make | 1,982 ml |
| Solution (E1) | |
| 0.4 mol/l aqueous potassium bromide solution | |
| Amount: necessary to adjust silver potential | |
| Solution (F1) | |
| Potassium hydroxide | 0.71 g |
| Water to make | 20 ml |
| Solution (G1) | |
| Aqueous 56% acetic acid solution | 18.0 ml |
| Solution (H1) | |
| Anhydrous sodium carbonate | 1.72 g |
| Water to make | 151 ml |

Compound (K):
$HO(CH_2CH_2O)n(CH(CH_3)CH_2O)_{17}(CH_2CH_2O)mH$
(m + n = 5–7)

Using the stirring device described in JP-B Nos. 58-58288 and 58-58289, ¼ of solution (B1), and the total amount of solution (C1) were added to solution (A1) by double jet addition over 4 min 45 sec. to form nucleus grains, while maintaining a temperature of 40° C. and a pAg of 8.09. After 1 min., the total amount of solution (F1) was added thereto, and followed that added were 20 ml of 5% aqueous solution of 4-hydroxy-6-methyl-1,3,3a,7-tetrazainden, while the pAg was appropriately adjusted using solution (E1). After 6 min., ¾ of solution (B1) and the total amount of solution (D1) were further added by double jet addition over 14 min 15 sec., while maintaining a temperature of 40° C. and a pAg of 8.09. After stirring for 5 min., the total amount of solution (G1) was added thereto to coagulate the resulting silver halide emulsion. Of the remaining 2,000 ml of precipitates, the supernatant was removed and 10 L of water were added, and after stirring, the silver halide emulsion was again coagulated. Of the remaining 1,500 ml of precipitates, the supernatant was removed and 10 L of water were added and after stirring, the silver halide emulsion was again coagulated. Of the remaining 1,500 ml of precipitates, the supernatant was removed and solution (H1) was added. The temperature was raised to 60° C. and stirring continued for a further 120 min. Finally, the pH was adjusted to 5.8 and water was added thereto so that the weight per mol of silver was 1,161 g, after which the light-sensitive silver halide emulsion was thus produced.

It was proven that the resulting emulsion was comprised of monodispersed silver iodobromide cubic grains having an average grain size of 0.050 μm, a coefficient of variation of grain size of 14% and a (100) face ratio of 93%.

Further, chemical sensitization was accomplished as follows. 240 ml of triphenylphosphinsulfide (0.5 % methanol solution) were added to the above emulsion and then a chloroaurate sensitizer at 1/20 equimolar amount of the foregoing chemical sensitizer was added and stirred for 120 min., maintained at a temperature of 55° C. This was designated as a light-sensitive silver halide emulsion.

Preparation of Powdery Aliphatic Carboxylic Acid Silver Salt

Behenic acid of 130.8 g, arachidic acid of 67.7 g, stearic acid of 43.6 g and palmitic acid of 2.3 g were dissolved in 4,720 ml of water at 80° C. Then, 540.2 ml of aqueous 1.5 mol/L NaOH were added, and after further adding 6.9 ml of concentrated nitric acid, the mixture was cooled to 55° C. to obtain an aliphatic acid sodium solution. To the thus obtained aliphatic acid sodium solution, 45.3 g of light-sensitive silver halide emulsion-1 obtained as above and 450 ml of water were added and stirred for 5 min., while maintained at 55° C.

Subsequently, 702.6 ml of 1 mol/L aqueous silver nitrate solution was added over 2 min. and stirring continued further for another 10 min to obtain a powdery aliphatic carboxylic acid silver salt dispersion, after removing any aqueous soluble salts. Thereafter, the obtained aliphatic carboxylic acid silver salt dispersion was transferred to a washing vessel, and then allowed to stand to separate the aliphatic carboxylic acid silver salt dispersion by floatation, removing water-soluble salts as below. Thereafter, washing with deionized water and filtration were repeated until the filtrate reached a conductivity of 50 μS/cm. After centrifugal dewatering using an air flow type dryer, Flush Jet Dryer (produced by Seishin Kigyo Co., Ltd.), the thus obtained cake-like aliphatic carboxylic acid silver salt was dried under nitrogen gas atmosphere, according to the operation condition of a hot air temperature at the inlet of the dryer, until the silver salt reached a moisture content of 0.1% to obtain dried powdery aliphatic carboxylic acid silver salt-1. The moisture content of the aliphatic carboxylic acid silver salt was measured by an infrared ray aquameter.

Preparation of Pre-dispersion Solution 14.57 g of polyvinyl butyral resin were dissolved in 1,457 g of MEK, and further thereto, 500 g of powdery aliphatic carboxylic acid silver salt-1 were gradually added to obtain a pre-dispersion solution, while stirring sufficiently employing a disolver type homogenizer (DISPERMAT CA-40, available from VMA-GETZMANN).

Preparation of Light-sensitive Emulsion Dispersion

The pre-dispersion solution was transferred to a media type dispersion machine (DISPERMAT Type SL-C12EX, available from VMA-GETZMANN), which was packed with 0.5 mm zirconia beads (TORAY-SELAM, available from Toray Co. Ltd.) to 80%, and dispersed at a circumferential speed of 8 m/s for 1.5 min of duration with a mill to obtain a light-sensitive emulsion dispersion.

Preparation of Additive Solution A 1.0 g of large ring compound S-19 of this invention containing a hetero atom, to be described below, and 0.31 g of potassium acetate were dissolved in 4.97 g of methanol to obtain additive solution A.

Large Ring Compound S-19

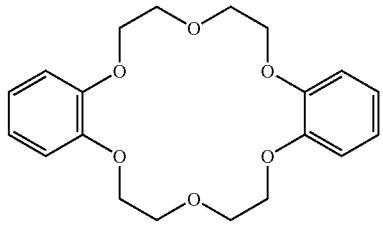

Preparation of Infrared Sensitizing Dye Solution A 19.2 mg of infrared sensitizing dye 1-3 (exemplified compound described in JP-A 2003-308582), 1.488 g of 2-chlorobenzoic acid, 2.779 g of Stabilizer 2 and 365 mg of 5-methyl-2-mercaptobenzimidazole were dissolved in 31.3 ml of MEK in a darkroom to obtain infrared sensitizing dye solution A.

Infrared Sensitizing Dye 1-3

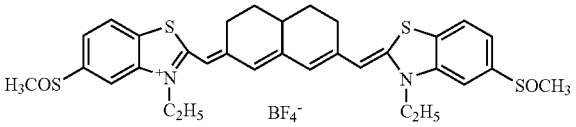

Preparation of Additive Solution a1

14.0 g of developer 1,1-bis(2-hydroxy-3,5-dimethylphenyl)-3,5,5-trimethylhexane, 1.54 g of 4-methylphthalic acid and 0.48 g of the foregoing infrared dye 1-3 were dissolved in 110 g of MEK to obtain additive solution a1.

Preparation of Additive Solution b 3.43 g of phthalazine was dissolved in 40.9 g of MEK to obtain additive solution "b".

Preparation of Additive Solution c 3.56 g of antifoggant 2 and 0.25 g of sodium p-tolueneth-iosulfonate were dissolved in 40.9 g of MEK to obtain additive solution "c".

Antifoggant 2

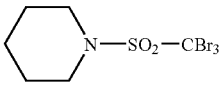

Preparation of Light-sensitive Layer Coating Composition

Under an inert gas atmosphere (97% nitrogen), the foregoing light-sensitive emulsion dispersion (50 g) and 15.11 g MEK were maintained at 21° C. while stirring, and 390 μl of antifoggant 1 (10% methanol solution) were added thereto and stirred for 1 hr. Subsequently, a methanol solution of iridium chloride was added thereto to achieve 1.0×10−5 mol per mol of silver halide, and further thereto, 494 μl of calcium bromide (10% methanol solution) were added and stirring for 30 min Subsequently, 0.21 g of foregoing additive solution A and 1.32 g of foregoing infrared sensitizing dye solution A were added and stirred for 1 hr. Thereafter, the temperature of the mixture was lowered to 13° C. and further stirred for 30 min. While maintaining 13° C., 13.31 g of poly (vinyl acetal) resin as a binder resin were added thereto and stirred for 30 min., after which 1.084 g of tetrachlorophthalic acid (9.4 weight % of MEK solution) were added and stirred for 15 min. Following that, 12.43 g of additive solution a1, 1.6 ml of 10% MEK solution of Desmodur N3300 (aliphatic isocyanate, produced by Movey Co.), 4.27 g of additive solution "b" and 10.0 g of additive solution "c" were successively added while stirring to obtain the light-sensitive layer coating composition.

Antifoggant 1

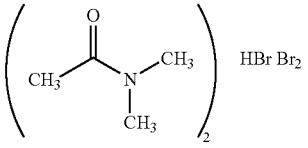

Preparation of Matting Agent Dispersion Solution 7.5 g of cellulose acetate-butyrate (CAB 171-15, produced by Eastman Chemical Co.) was dissolved in 42.5 g of MEK while stirring and further thereto, 5 g of calcium carbonate (Super-Pflex 200, produced by Speciality Minerals, Inc.) was added and stirred at 8,000 rpm for 30 min., using a dissolver type homogenizer to obtain a matting agent dispersion solution.

Preparation of Surface Protective Layer Coating Composition 96 g of cellulose acetate-butyrate (CAB 171-15, produced by Eastman Chemical Co.), 4.5 g of polymethyl methacrylate (Paraloid A-21, produced by Rohm & Haas Co.), 1.5 g of vinyl sulfone compound (VSC), 1.0 g of benzotriazole, and 1.0 g of a fluorinated surfactant (Surflon KH 40, produced by Asahi Glass Company) were added to 865 g of MEK (methyl ethyl ketone), and dissolved. Further thereto, 30 g of the foregoing matting agent dispersion solution was added while stirring to obtain a surface protective layer coating composition.

Vinyl Sulfone Compound (VSC): $CH_2{=}CHSO_2CH_2)_2CHOH$

Preparation of Silver Salt Photothermographic Dry Imaging Material Samples

Using a commonly known extrusion type coater, the thus prepared light-sensitive layer coating composition and the protective layer coating composition were simultaneously applied to surface "a" to prepare the samples. The coating was conducted so that the silver amount of the light-sensitive layer was $1\times10^{-4}$ g/m$^3$ per unit volume resulting in a dry protective layer thickness of 2.5 μm. Drying was achieved using air at a dry bulb temperature of 75° C. and a dew point of 10° C. for 10 min., whereby the samples were prepared.

Coating Characteristics of BC Layer (Back Coating Layer)

The coating characteristics of the BC layer of the obtained samples were evaluated based on the following criteria.

5: No problems since the coated surface was completely flat.
4: Very slight phase-separation was observed.
3: A little phase-separation was observed.
2: Obvious phase-separation structure was observed.
1: Obvious phase-separation was obviously observed, and the surface was rough.

Evaluation

Measurement of Electrostatic Charge Amount

A piece measuring 10×12 inches was prepared from each obtained sample and subjected to conditioning in an environmental conditioning room at 23° C. and 20% RH for 48 hrs. Further, removed was the roller which might contact the back coating layer first, after the sensitized material was developed with an automated developing apparatus for photothermographic sensitized materials (Drypro 751), and that roller was also subjected to conditioning in the same room for 48 hrs.

Thereafter, each piece of the photosensitized materials was placed on a 0.5 cm thick polypropylene sheet so that the back coating layer was upside down. Then, electrostatic charges of the photosensitized materials and the polypropylene sheet were eliminated using ionized blows air and electrical grounding, and the electrostatic charge amount was confirmed to be 0 V using an electrostatic charge measuring instrument (STATIRON M, manufactured by SHISHIDO ELECTROSRATIC, LTD.). Thus, measured was the electrostatic charge amount generated by back and forth rolling of 20 times with the previously removed roller.

Adhesion at a High Temperature

From the obtained samples, pieces of 18 cm×18 cm were cut, and subjected to conditioning in the environmental conditioning room at 23° C. and 20% RH for 48 hrs. Thereafter, the pieces were closely contacted in an area of 10×15 cm onto a stainless steel roller the surface of which was heated to 130° C., and pressed at a load of 15 Kg (pressure of 50 g/cm$^2$) for 60 sec. while manually pulling both sides of the piece. Then, transfer onto the stainless roller was visually observed based on the following evaluation criteria.

5: No transfer at all was observed.
4: Several transferred patches of about 1 mm$^2$ were observed.
3: Transferred patches of a few mm$^2$ were observed.
2: Transferred patches were slightly observed over the whole area.
1: Transfer of portions of layers was observed.

In cases when the result was a value of 4 or higher, it caused no problem in practice, since this test was based on a forced aging test.

Adhesion at a High Humidity

From the obtained samples, pieces of 18 cm×30 cm were cut out, and subjected to conditioning in an environmental conditioning room at 23° C. and 80% RH for 48 hrs. Thereafter, the back coating surface and the emulsion surface were displaced by 90 degree to tie in each other to overlap in 18×18 cm$^2$, and further contacted under pressure of 5 kg/m$^2$ for 6 hrs. Then, the samples were peeled off to evaluate based on the following criteria.

5: Almost no force was needed to peel the samples away.
4: There were several adhered areas of about 1 mm$^2$, but almost no force was needed to peel the samples away.
3: The whole area was adhered, and peeled off with only slight force.
2: Parts of layers were peeled away.
1: The samples were torn from the supports.

In cases when the result was a value of 4 or higher, it caused no problems in practice, since this test was accomplished based on a forced aging test.

Transportability within Automated Developing Apparatus

A 10×12 inch piece was prepared from each obtained sample and subjected to conditioning in an environmental conditioning room at 23° C. and 20% RH for 48 hrs. Further, an automated developing apparatus for photothermographic sensitized materials (Drypro 751) was also subjected to conditioning at the same time in the environmental conditioning room for 48 hrs. Using this apparatus, 100 sheets of each sample were transported within the apparatus. Each sample using the polymer of this invention was transported without trouble, however, tears were observed on several sheets of the comparative sample.

TABLE 2

| Classification of Invention No. | Sample No. | *1 | Chemical Formula 1 M-5210 | M-1210 | R-1420 | Chemical Formula 2 MMA | CHMA | GMA | *2 | Evaluation Electrostatic Discharge KV | Adhesion at High Temperature | Adhesion at High Humidity |
|---|---|---|---|---|---|---|---|---|---|---|---|---|
| | | | mol % | | | | | | | | | |
| This Invention | 1 | PA-1 | 12 | 13 | | 75 | | | 3.2 | 0.1 | 5 | 5 |
| | 2 | PA-2 | 10 | 10 | | 80 | | | 2.7 | 0.3 | 5 | 4 |
| | 3 | PA-3 | 17 | 17 | | 67 | | | 3.9 | 0.05 | 5 | 5 |
| | 4 | PA-4 | 25 | 25 | | 50 | | | 5.3 | 0 | 5 | 5 |
| | 5 | PA-5 | 33 | 33 | | 33 | | | 6.3 | 0 | 5 | 5 |
| | 6 | PA-6 | 38 | 38 | | 25 | | | 6.7 | 0 | 5 | 5 |
| | 7 | PA-7 | 5 | 20 | | 75 | | | 3.4 | 0.03 | 5 | 5 |
| | 8 | PA-8 | 20 | 5 | | 75 | | | 3.0 | 0.15 | 5 | 5 |
| | 9 | PA-9 | | | 10 | | 90 | 0 | 1.7 | 0.2 | 5 | 4 |
| | 10 | PA-10 | | | 20 | | 80 | 0 | 3.3 | 0.15 | 5 | 4 |
| | 11 | PA-11 | | | 25 | | 75 | 0 | 3.9 | 0.05 | 4 | 5 |
| | 12 | PA-12 | | | 33 | | 67 | 0 | 4.9 | 0 | 4 | 5 |
| | 13 | PA-13 | | | 50 | | 50 | 0 | 6.7 | 0 | 4 | 5 |
| | 14 | PA-14 | | | 67 | | 33 | 0 | 4.1 | 0 | 4 | 5 |
| | 15 | PA-15 | | | 33 | | 57 | 10 | 4.0 | 0 | 5 | 5 |
| Comparative Example | 16 | PA-16 | | | 100 | | | | 3.3 | 0.15 | 2 | 2 |
| | 17 | PA-17 | | | 0 | | 87 | 13 | 0.0 | 1.5 | 3 | 3 |
| | 18 | None | | | | | | | 0.0 | 1.3 | 5 | 3 |

*1; Added Copolymer
*2; Polymer-derived Fluorine Amount mmol/$m^2$
Comp.: Comparative Compound
Note 1:
MMA: methyl methacrulate
CHMA: cyclohexyl methacrylate
GMA: glysidil methacrylate

Example 2

Samples were prepared in the same manner as Example 1, except that Subbing Layer Coating Composition E was used instead of Subbing Layer Coating Composition C, and Subbing Layer Coating Composition F was used instead of Subbing Layer Coating Composition D, which were used for Sample Nos. 1, 2 and 9 of Example 1, after which the samples were evaluated. The obtained samples were designated as 1-2, 2-2 and 9-2 respectively, and the results are shown below.

Subbing Layer Coating Composition E

| | |
|---|---|
| Polymer latex solution (solid content of 30%) comprising 40 w % of n-butyl acrylate, 20 w % of styrene and 40 w % of glycidyl methacrylate | 53 g |
| Surface active agent (UL-1) | 0.6 g |
| Water to make | 1,000 ml |

Subbing Layer Coating Composition F

Preparation of Co-polymerized Polyester 34.07 weight parts of dimethyl terephthalate, 32.36 weight parts of dimethyl isophthalate, 17.94 weight parts of dimethyl 5-sulfoisophthalate sodium salt, 56.01 weight parts of ethylene glycol, 0.0065 weight parts of calcium acetate monohydrate, and 0.0022 weight parts of manganese acetate tetrahydrate were heated to 170–220° C. under nitrogen stream to distilled out methanol for theoretical equivalence, and further, after ester interchange reaction was conducted, 0.04 weight parts of trimethyl phosphate, and 0.04 weight parts of antimony trioxide and 6.04 weight parts of 1,4-cyclohexanedicarboxylic acid, being as polycondansation catalysts, were added. After that, water of about theoretical equivalence was distilled to esterify at a reaction temperature of 220–235° C. Further, the inside of the reaction system was conducted to reduced the pressure over about one hour, and raised the temperature, and finally at 280° C., and less than 133.3 Pa, polycondensation was conducted over about one hour to obtain Co-polymerized Polyester. Intrinsic viscosity of this copolymerized polyester was 0.33. The composition of the dibasic acids was dicarboxylic acid having sulfonic acids/alicyclic dicarboxylic acid/terephthalic acid/isophthalic acid=14/8/40/38 (mol % ratio).

To a four neck flask (a reaction vessel) of 1.0 liter having a stirring blade, a reflux condenser, a thermometer, and further an input port, 484.5 ml of pure water was added through the input port while the stirring blade was active, and 85.5 g of the co-polymerized polyester obtained above was gradually added over 10 min., and the input port was sealed with a ball stopper. After that, the reaction vessel was heated to an interior temperature of 95° C., and maintained at that temperature for 3 hrs. During heating, into a dropping funnel, 11.4 g of methyl methacrylate, 7.9 g of ethyl acrylate and 2.1 g of glycidyl methacrylate were carefully weighed and stirred well. After heating at 95° C. for 3 hrs. as above, the interior temperature of the reaction vessel was lowered to 80° C., while nitrogen gas was continuously blown into the reaction vessel. When the temperature in the vessel reached to 80° C., the ball stopper was opened, and added in one batch was a polymerization initiator aqueous solution (a solution dissolved 0.456 g of ammonium peroxodisulfate into 1.5 g of water) dissolved in advance, after which the ball stopper was replaced. Five min. after the polymerization initiator aqueous solution was added, the ball stopper in the input port was replaced by a dropping funnel containing the mixed monomers, and the mixed monomers were dripped in over 20 min. When the dropping funnel was empty, 6 ml of water was added into it to wash out any remaining monomers in the funnel. About one hr. after addition of the polymerization initiator aqueous solution, no reflux of the monomers was observed, but the inner temperature was maintained at 80° C. to conduct the reaction for a further 2 hrs. After that, the inner temperature of the vessel was lowered to less than 30° C. using cold water whereby water dispersions of Co-polymerized Polyester was obtained.

Preparation Method of Anti-static Water Dispersions

A stirring blade and a dropping funnel were attached to a 200 ml three neck flask. In the three neck flask, 60.9 g of commercially available tin oxide dispersion SN-100S (17.5 wt % of solid content of tin oxide sol, produced by ISHIHARA SANGYO KAISHA, LTD.) was added, and 39.1 g of the monomer water dispersion was added to the dropping funnel, and then the monomer water dispersion was added over 10 min. while the stirring blade were activated. After the total amount was added, the obtained Anti-static Water Dispersions was removed. The ratio of the tin oxide compound to the polymerized polyester in this mixture was 4/6 in conversion of solid content.

| | |
|---|---|
| Anti-static Water Dispersions | 137 g |
| Surface active agent (UL-1) | 1.0 g |
| Co-polymerized Polyester Water Dispersion | 41.6 g |
| Water to make | 1,000 ml |

TABLE 3

| | Electrostatic Discharge KV | Adhesion at High Temperature Ranking | Adhesion at High Humidity Ranking | Remarks |
|---|---|---|---|---|
| 1-2 | 0 | 5 | 5 | Inv. |
| 2-2 | 0 | 5 | 5 | Inv. |
| 9-2 | 0 | 5 | 5 | Inv. |

Inv.: This Invention

As is apparent from the results, it was proved that the silver salt photothermographic dry imaging materials to which the polymers of this invention was added, exhibited no transportation problems due to electrostatic charges.

According to the present invention, for a silver salt photothermographic dry imaging materials, it is possible to provide an antistatic technology exhibiting non-transfer nor tackiness even under conditions of a high temperature and a high humidity, and to provide a novel antistatic agent, which is easily dissolved in solvents.

What is claimed is:

1. A silver salt photothermographic dry imaging material comprising a support having thereon a photosensitive layer and a polymer layer, wherein the polymer layer is provided as a back coating layer on a side of the support opposite the photosensitive layer and the polymer layer comprises a cellulose ester and a copolymer of:

(i) a fluorine containing acrylate or a fluorine containing methacrylate represented by Formula (1):

Formula (1)

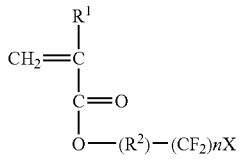

wherein, $R^1$ represents a hydrogen atom, a fluorine atom or a methyl group; $R^2$ represents a methylene group, an ethylene group or a 2-hydrokypropylene group; X represents a hydrogen atom or a fluorine atom; and n represents an integer of 1 to 4; and (ii) a monomer having a hydrophobic group in the molecule; and wherein the copolymer is produced by a pearl polymerization method.

2. The silver salt photothermographic dry imaging material of claim 1, wherein an amount of fluorine contained in the copolymer is not less than 4 mmol/$m^2$.

3. The silver salt photothermographic dry imaging material of claim 1, wherein an amount of the copolymer in the polymer layer is 0.1 to 15% based on the total weight of the polymer layer.

4. The silver salt photothermographic dry imaging material of claim 1, wherein the monomer having a hydrophobic group in the molecule is represented by Formula (2):

Formula (2)

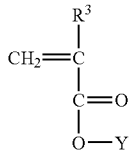

wherein, $R^3$ represents a hydrogen atom or a methyl group; and Y represents an alkyl group, an cyclic alkyl group or an aromatic group.

5. The silver salt photothemographic dry imaging material of claim 1, wherein the copolymer further comprises a monomer having an epoxy group.

6. The silver salt phototherniographic dry imaging material of claim 1, wherein the copolymer contains at least 20 mol % of a monomer represented by Formula (1).

7. The silver salt photothermographic dry imaging material of claim 1, comprising further an electrically conductive layer containing a polyester copolymer and a tin oxide compound.

* * * * *